United States Patent [19]

Christensen

[11] 4,020,757

[45] May 3, 1977

[54] MACHINE FOR MARKING OBJECTS

[75] Inventor: Hans Christensen, Frederikssund, Denmark

[73] Assignee: H. Nielsen & Son Maskinfabrik A/S, Herlev, Denmark

[22] Filed: Sept. 23, 1975

[21] Appl. No.: 615,969

[30] Foreign Application Priority Data

Oct. 1, 1974 Germany ..... 2446904

[52] U.S. Cl. ..... 101/18; 101/110; 197/55

[51] Int. Cl.[2] ..... B44B 5/00; B41J 1/60

[58] Field of Search ..... 101/18, 29, 13, 14, 101/42, 35, 44, 41, 43, 110, 368, 334, 3, 4; 197/6.7, 55

[56] References Cited

UNITED STATES PATENTS

| | | | |
|---|---|---|---|
| 1,929,703 | 10/1933 | McDonough | 101/43 |
| 1,940,767 | 12/1933 | Perkins | 101/3 R |
| 2,201,302 | 5/1940 | Rowe | 101/41 X |
| 2,819,669 | 1/1958 | Glunz | 101/35 |
| 2,952,204 | 9/1960 | Sherman | 101/35 |
| 3,107,606 | 10/1963 | Baratelli | 101/110 X |
| 3,112,688 | 12/1963 | Pannier | 101/18 X |
| 3,115,826 | 12/1963 | Reinhardt et al. | 101/41 |
| 3,126,822 | 3/1964 | Pannier et al. | 101/43 X |
| 3,306,186 | 2/1967 | Voos et al. | 101/29 X |
| 3,364,856 | 1/1968 | Lind | 101/334 |
| 3,530,792 | 9/1970 | Valiela | 101/41 |
| 3,559,791 | 2/1971 | Waidenburger | 101/110 X |
| 3,750,791 | 8/1973 | McReynolds | 197/6.7 |

*Primary Examiner*—Edgar S. Burr
*Assistant Examiner*—Paul J. Hirsch
*Attorney, Agent, or Firm*—Beveridge, DeGrandi, Kline & Lunsford

[57] ABSTRACT

Machine for marking objects, such as steel sheets, comprising a frame, a raisable and lowerable holding cylinder being suspended from the frame, and an embossing head being arranged beneath and connected to the holding cylinder. An embossing wheel shaft being arranged in the embossing head, and a plurality of embossing wheels being arranged on the embossing wheel shaft. The embossing wheel shaft is connected to a driving motor, secured to the embossing head at the bottom, said embossing wheel shaft being formed so as the embossing wheels one by one are pressed down towards the object when the embossing wheel shaft is turned by means of the driving motor.

13 Claims, 8 Drawing Figures

MACHINE FOR MARKING OBJECTS

The invention relates to a machine for marking objects, such as steel sheets, having a frame, a raisable and lowerable holding cylinder, said holding cylinder being suspended from the frame, particularly in the middle of the frame, and an embossing head being arranged beneath and connected to the holding cylinder, an embossing wheel shaft being arranged in said embossing head, a plurality of embossing wheels being arranged side by side and mounted on the embossing wheel shaft, each embossing wheel having projecting embossing characters along its outer periphery and being pivotally arranged permitting one character at a time to be placed in an embossing position, in which the embossing character may be pressed down towards the object.

Such machines are preferably intended for marking sheet metal used e.g. at shipyards and rolling mills.

BACKGROUND OF THE INVENTION

Marking machines of the type as stated in the opening paragraph are known, in which, when marking a sheet-shaped object, the embossing wheels mounted on the embossing wheel shaft at a time are pressed down towards the object by means of the pressure of the holding cylinder, the total embossing pressure is relatively high, since the total embossing pressure is equal to the sum of the embossing pressures of each embossing wheel. In order to enable the frame of the machine to absorb this high pressure the frame must be made of heavy sectional irons resulting in a heavy frame of great strength. This, however, increases the production costs. Another drawback to the known marking machines is that it may be difficult to adjust the penetration depth of the embossing characters into the surface of the object, the penetration depth being dependent on the hardness of the material. A third drawback is that an unevenness or a foreign body, as e.g. a mill scale, on the object will have a damaging influence on the characters embossed on the object. A foreign body under one of the outer embossing wheels may e.g. make the embossing head with the embossing wheel shaft tilt, and thereby it may cause the embossing depth of the different characters of the embossing wheels to vary, dependent on the distance between each embossing wheel and the foreign body. Consequently the embossed characters on the object will be difficult to read or may even be illegible.

The object of the invention is to provide a machine of the type as stated in the opening paragraph having a frame that is light as compared with the frame of the known machines, and that provides a predetermined penetration depth of the embossing characters into the object, as well as reduces considerably the influence of the unevennesses and the foreign bodies on the completed embossing result.

SUMMARY OF THE INVENTION

The machine according to the invention is characterized in that the embossing wheel shaft is connected to a driving motor, secured to the embossing head at the bottom, said embossing wheel shaft being formed so as the embossing wheels one by one are pressed down towards the object when the embossing wheel shaft is turned by means of the driving motor.

When marking an object by means of such a machine the object is e.g. moved along a roller conveyor situated beneath the machine and is stopped. Then the embossing head is lowered on the object by means of the piston rod of the holding cylinder. Subsequently the embossing wheel shaft is turned by means of the driving motor attached to the bottom of the embossing head, by which sequence of operation the embossing wheels one by one are pressed down towards the object, each embossing wheel embossing a character into the surface of the object. Therefore the machine must be able to exert a low embossing pressure only, i.e. corresponding to the embossing of a single embossing wheel and not of all the embossing wheels, e.g. four, of the embossing head simultaneously. By dimensioning the frame in accordance with this low embossing pressure, a frame being light and cheap as compared with a frame of the known machines is achieved. Furthermore in spite of the foreign bodies sitting on the object an easier legible marking than the marking of the known machines is achieved, as a foreign body under an embossing wheel has no influence on the embossing of the other embossing wheels of the embossing wheel shaft, since the embossing wheels one by one are pressed down towards the object.

According to the invention the embossing wheel shaft may be formed as an eccentric shaft having a plurality of eccentric sheaves spaced apart and attached to the embossing wheel shaft, each eccentric sheave being mounted in a plain or anti-friction bearing placed in the middle of each embossing wheel, thereby permitting each embossing wheel and the embossing wheel shaft with eccentric sheaves to be turned independently of each other, the centres of these eccentric sheaves being situated in different planes through the center-line of the embossing wheel shaft, and a blocking mechanism provided with blocking members may be arranged on the embossing head, the blocking members being meshable with the periphery of the embossing wheels when the embossing wheel shaft is turning. As a result, the embossing wheels are eccentrically arranged on the embossing wheel shaft, making each embossing wheel follow the movement of the eccentric sheave when the embossing wheel shaft is turned, and preventing the embossing wheels from turning in consequence of the mesh of the embossing wheel with a blocking member. Thus it is ensured, that the adjustment of the embossing wheel, corresponding to a predetermined embossing character on its periphery, is unchanged when the embossing wheel shaft is turned. Since the centres of the eccentric sheaves are angularly displaced in relation to each other the embossing wheels will be pressed down one by one and not simultaneously towards the object when the embossing wheel shaft is turned, and thus emboss the object with the character on the embossing wheel in advance placed in the embossing position.

Furthermore according to the invention the eccentric sheaves preferably are of equal size. This provides a simple construction of the embossing wheel shaft, by which the centres of the eccentric sheaves will be arranged on a circle having its centre on the center-line of the embossing wheel shaft, and a radius being equal to the eccentricity of the eccentric sheaves.

Moreover according to the invention the centres of the eccentric sheaves may be situated in planes through the center-line of the embossing wheel shaft, said planes having equal angular distances relative to each other around the axis of the embossing wheel shaft. This provides a steadier cycle of operations of the machine during the embossing process.

According to the invention each embossing wheel may be in the form of a gear wheel with external tooth gearing, the gear wheel being securable by means of a blocking member in the blocking mechanism when the embossing wheel shaft is turned, each gear wheel furthermore being in mesh with an adjusting gear wheel situated in an adjusting mechanism being placed in the embossing head above the embossing wheels, said adjusting mechanism being adapted so as to adjust the embossing wheel by bringing a predetermined embossing character in the embossing position, when the embossing wheel shaft stands idle. Thus it is possible in a simple way both to secure the embossing wheel when the embossing wheel shaft is turning during the embossing process, and to adjust the embossing wheel bringing the wanted character in the embossing position when the embossing wheel shaft stands idle.

Furthermore the embossing head may on its bottom side be provided with one or more rigid supporting legs, the lower edge of which is equally spaced from the center-line of the embossing wheel shaft. By means of such supporting legs a predetermined penetration depth of the projecting embossing characters of the embossing wheels into the surface of the object is achieved, irrespective of the hardness of the material of the object, the lower edge of said supporting legs being at a suitable distance from the center-line of the embossing wheel shaft in relation to the radius of the embossing wheels and to the eccentricity of the eccentric sheaves. However, it is only possible to obtain a predetermined penetration depth if the surface of the object is plane, and furthermore if there are no foreign bodies under the supporting legs.

Moreover according to the invention the rigid supporting legs may be adjustable. Thus it is possible to adjust the penetration depth of the embossing characters into the surface of the object, and furthermore it is possible to adjust the distance between the lower edge of the supporting legs and the centerline of the embossing wheel shaft in case that the embossing characters of the embossing wheels are worn.

Furthermore according to the invention each adjustable supporting leg may consist of a nut, secured to the bottom of the embossing head, and a screw screwed into said nut. This screw is provided with a thrust pad. This results in a simple construction of a supporting leg, the length of which is easily and exactly adjusted.

According to one embodiment of the invention the embossing head may on its bottom side be provided with one or more resilient supporting legs. This embodiment is advantageous because the embossing character of each embossing wheel is pressed down towards the surface of the object by a predetermined pressure, being equal to the pressure of the holding cylinder, even if the surface of the object is not completely plane, e.g. due to a dent in the object, and even if there are some mill scales or the like foreign bodies on the object under the supporting legs.

Moreover according to the invention each resilient supporting leg may consist of a plurality of cup springs and a guide spindle through the cup springs. This results in a very simple construction of the resilient supporting leg.

Furthermore according to the invention the embossing wheel shaft may at its end opposite to the driving motor be connected to an encoder, secured to the outside of the embossing head. This encoder provides partly an indication of the position of the embossing wheel shaft, i.e. the size of the present angular displacement of the embossing wheel shaft, and partly a demonstration of the fact that the embossing wheel shaft is in fact turning.

Furthermore according to the invention if the driving motor is hydraulically operated a pressure measuring means may be connected to the inlet pipe for pressure fluid of the driving motor. Since such a pressure measuring means measures a pressure in the inlet pipe, substantially being proportional to the embossing pressure, it is possible to supervise that the real embossing pressure of each embossing character corresponds to the predetermined pressure, e.g. by means of electronic equipment, when comparing the measuring values of the angular displacement and the embossing pressure, read on the encoder and the pressure measuring means respectively.

Finally according to the invention the holding cylinder may be provided with a pressure registering member. Thus it is possible to control the pressure by which the holding cylinder acts on the embossing head.

BRIEF DESCRIPTION OF THE DRAWING

The invention will be described below with reference to the accompanying drawings, in which.

DESCRIPTION OF THE PREFERRED EMBODIMENTS

Figure 1:
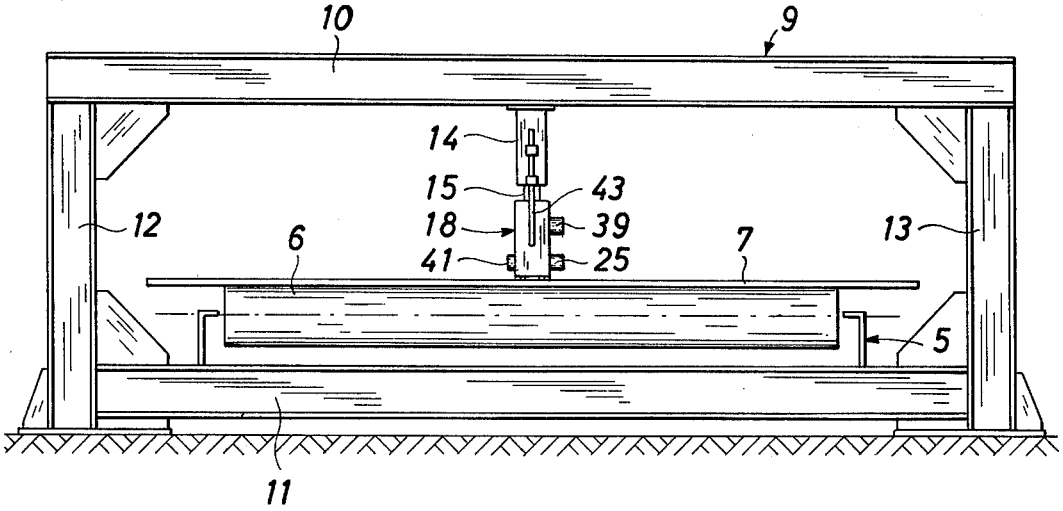
FIG. 1 is a front view (in the transport direction) of an embodiment of the machine according to the invention in connection with a sheet rolling on a roller conveyor.
Figure 2:
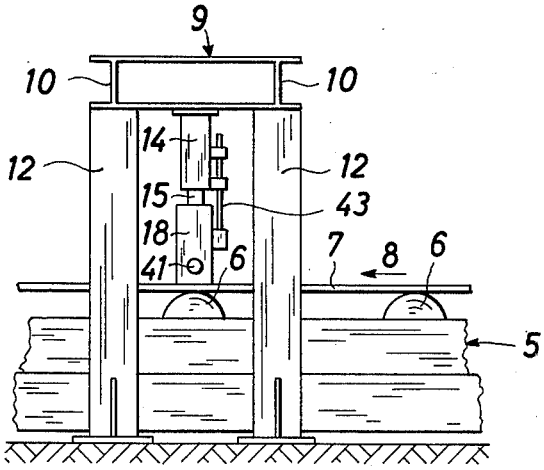
FIG. 2 is an end view of the machine illustrated in FIG. 1.

FIGS. 1 and 2 show a machine in connection with a roller conveyor 5, having rolls 6 and carrying a sheet-shaped object 7 to the machine. The transport direction of the sheet-shaped object 7 may e.g. be the direction indicated by the arrow 8.

The machine is particularly intended for marking sheet-shaped objects as e.g. steel sheets.

The machine comprises a closed portal-shaped frame 9, consisting of a plurality of horizontal beams 10 and 11 and vertical beams 12 and 13 being suitably connected. Furthermore the machine comprises a raisable and lowerable holding cylinder 14 being suspended from the frame 9, e.g. in the middle in case the sheet-shaped object 7 is to be marked in the middle. The holding cylinder 14 may effectively be suspended from a trolley moveable in the longitudinal direction of the sheet-shaped object 7, said trolley being displaceable crosswise of a trolley moving in the cross direction. The holding cylinder 14 comprises moreover a displaceable piston rod 15, and may advantageously be a hydraulic or a pneumatic cylinder. The lower end of the piston rod 15 is connected to an embossing head 18 by means of hinge plates 16 and a pivot pin 17 (FIGS. 3 and 4).

Figure 4:
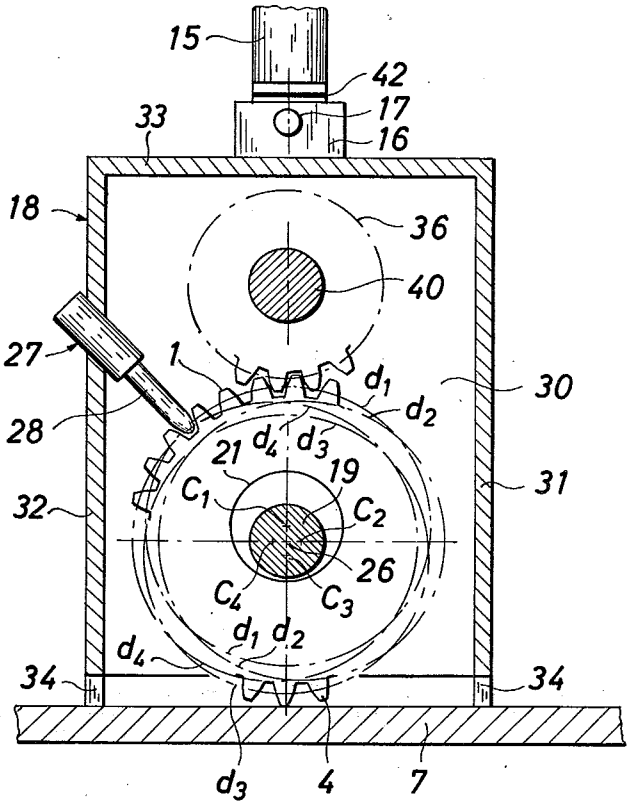
FIG. 4 is a diagrammatic sectional view taken along the line IV—IV of FIG. 3.
Figure 3:
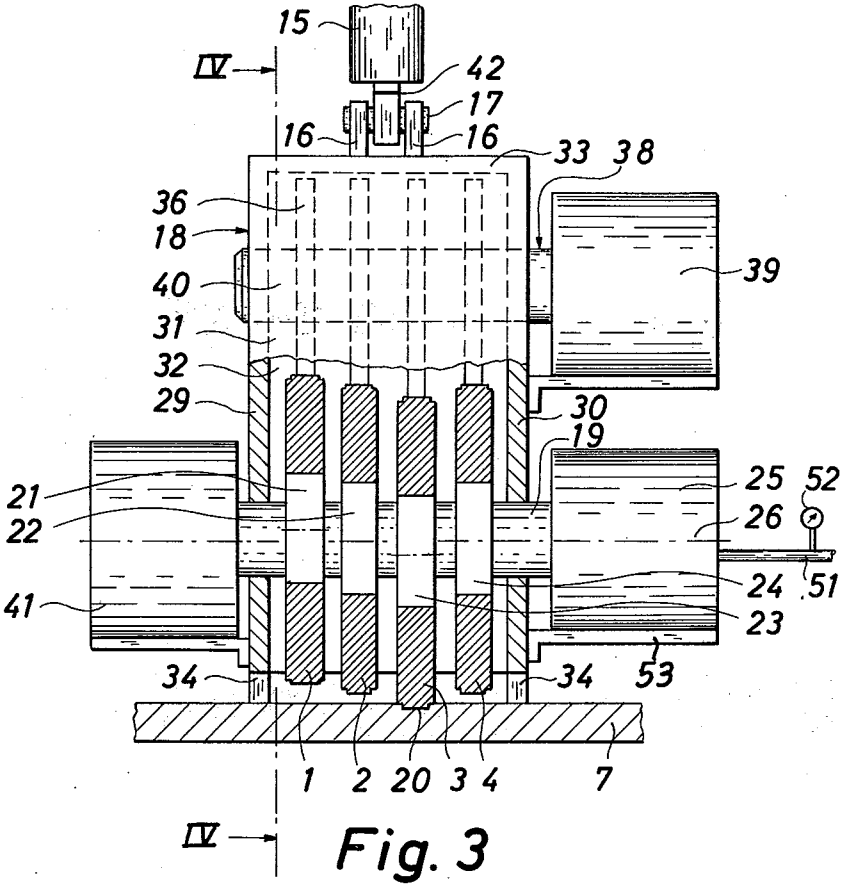
FIG. 3 is on a larger scale a diagrammatic view of the embossing head of the machine partly in section.

FIGS. 3 and 4 show the embossing head 18 on a larger scale. An embossing wheel shaft 19 is arranged at the bottom of the embossing head 18, a plurality of embossing wheels 1, 2, 3, and 4 being mounted side by side on said embossing wheel shaft 19. Each embossing wheel 1, 2, 3, and 4 has projecting embossing characters 20 along its outer periphery.

The embossing wheel shaft 19 is formed as an eccentric shaft, having a plurality of eccentric sheaves 21, 22, 23, and 24 spaced apart and being either attached suitably to the embossing wheel shaft 19 or formed in one piece with said embossing wheel shaft 19. Each eccentric sheave 21, 22, 23, and 24 carry an embossing wheel 1, 2, 3, and 4 respectively, and each eccentric sheave is mounted in a plain or anti-friction bearing placed in the middle of each embossing wheel. This construction permits each embossing wheel 1, 2, 3, and 4 and the embossing wheel shaft 19 with eccentric sheaves 21, 22, 23, and 24 to be turned independently. The bearing may e.g. be a ball-bearing. A driving motor 25 is connected to one of the ends of the embossing wheel shaft 19. This driving motor 25 is attached to the bottom of the embossing head 18 by means of a bracket 53. This driving motor 25 may be operated either hydraulically or pneumatically.

The centres $C_1$, $C_2$, $C_3$, and $C_4$ (FIG. 4) of the eccentric sheaves 21, 22, 23, and 24 are situated in different planes through the center-line 26 of the embossing wheel shaft 19. A blocking mechanism 27 with blocking members 28 is placed on the embossing head 18. These blocking members 28 may mesh into the periphery of the embossing wheels 1, 2, 3, and 4, and consequently secure these wheels when the embossing wheel shaft 19 is turning during the embossing process.

The mode of operating the machine will now be described. When marking, the object 7 rolls along the roller conveyor 5 situated beneath the machine, and is stopped. Then the embossing head 18 is lowered on the object 7 by means of the piston rod 15 of the holding cylinder 14. Subsequently the embossing wheel shaft 19 is turned by means of the driving motor 25, by which sequence of operation the embossing wheels 1, 2, 3, and 4, in consequence of their eccentric arrangement on the embossing wheel shaft 19, will follow the movement of the eccentric sheave, and not turn in consequence of the mesh of the embossing wheels 1, 2, 3, and 4 into the blocking mechanism 27. Thus it is ensured, that the adjustment of each embossing wheel 1, 2, 3, and 4, corresponding to a predetermined embossing character 20 on its periphery, is unchanged when the embossing wheel shaft 19 is turned. Since the centres, $C_1$, $C_2$, $C_3$, and $C_4$ of the eccentric sheaves 21, 22, 23, and 24 are equally angularly displaced in relation to each other and around the axis of shaft 19 (FIG. 4), the embossing wheels 1, 2, 3, and 4 will be pressed down one by one and not simultaneously towards the object 7 when the embossing wheel shaft 19 is turned, and thus emboss one character on the surface of the object 7. While the driving motor 25 is executing the embossing function, the embossing head 18 and so the holding cylinder 14 serves as holder-ons. Since the embossing wheels 1, 2, 3, and 4, as previously mentioned, are pressed down towards the object 7 one by one, it is only necessary the machine be capable of exerting a low embossing pressure, i.e. corresponding to the embossing of one embossing wheel and not of all the embossing wheels, e.g. four, of the embossing head 18. Therefore it is sufficient to dimension the frame 9 in accordance with this low embossing pressure, thereby obtaining a frame being light and cheap as compared with the frame of the known machines. Furthermore it implies that an unevenness or a foreign body, as e.g. a mill scale, under an embossing wheel will have no damaging influence on the embossing on the object of the other embossing wheels, since the embossing is made by one embossing wheel at a time. Thus a better embossing result is achieved, i.e. an easily legible marking.

The eccentric sheaves 21, 22, 23, and 24 are preferably at equal size. This provides a simple construction of the embossing wheel shaft 19, and the centres $C_1$, $C_2$, $C_3$, and $C_4$ of the eccentric sheaves 21, 22, 23, and 24 will be arranged on a circle having its centre on the center-line 26 of the embossing wheel shaft 19 (FIG. 4), and a radius being equal to the eccentricity of the eccentric sheaves 21, 22, 23, and 24, said radius may e.g. be about 1 mm.

Moreover the centres $C_1$, $C_2$, $C_3$, and $C_4$ of the eccentric sheaves 21, 22, 23, and 24 may be situated in planes containing the center-line 26 of the embossing wheel shaft 19, said planes having equal angular displacement relative to each other around the axis of the shaft. This provides a steadier cycle of operations of the machine during the embossing process.

As shown in FIG. 4 each embossing wheel 1 may advantageously be in the form of a gear wheel with external tooth gearing with the characters 20 formed on the outer surface of the gear teeth, the gear wheel being securable by means on the blocking mechanism 27 when the embossing wheel shaft 19 is turned. The pitch circles of the embossing wheels 1, 2, 3, and 4, formed as gear wheels, are indicated by $d_1$, $d_2$, $d_3$, and $d_4$ respectively. The embossing weel 1, shaped as a gear wheel, is in constant mesh with an adjusting gear wheel 36, situated in an adjusting mechanism 38 (FIG. 3) being placed in the embossing head 18 above the embossing wheels 1, 2, 3, and 4. Each of said embossing wheels 2, 3, and 4 is also being in constant mesh with an adjusting gear wheel 36 (FIG. 3). The adjusting mechansim 38 comprises a motor 39 and a driving shaft 40, said driving shaft 40 turning a plurality of adjusting gear wheels 36 via a slipper clutch. The motor 39 may be either hydraulically or pneumatically operated. When turning the adjusting gear wheel 36 suitably, the corresponding embossing wheel may be adjusted bringing a predetermined embossing character in the embossing position when the embossing wheel shaft 19 stands idle. The embossing wheels 1, 2, 3, and 4, shaped as gear wheels, and the adjusting gear wheels 36 are adapted for always being in mesh with each other, i.e. also when the embossing wheels 1, 2, 3, and 4 are moving eccentrically during the turning of the embossing wheel shaft 19.

As shown in FIGS. 1 and 2 a guide 43 has been provided to guide the embossing head 18 in relation to the holding cylinder 14.

As shown in FIGS. 3 and 4 the embossing head 18 comprises a housing consisting of the side walls 29, 30, 31, and 32 and a ceiling wall 33. This housing is in each corner provided with a supporting leg 34, i.e. four supporting legs 34 totally, on its bottom side. The lower edge of these supporting legs 34 are equally spaced from the center-line 26 of the embossing wheel shaft 19. By means of the supporting legs 34 a predetermined penetration depth of the projecting embossing characters of the embossing wheels into the surface of the object is achieved, irrespective of the hardness of the material of the object 7, the lower edge of said supporting legs 34 being at a suitable distance from the centerline 26 of the embossing wheel shaft 19 in relation to the radius of the embossing wheels 1, 2, 3, and 4 and to the eccentricity of the eccentric sheaves 21, 22, 23, and 24. However, it is only possible to obtain a predetermined penetration depth if the surface of the object is plane, and furthermore if there are no foreign bodies under the supporting legs 34. The embossing pressure is as previously mentioned produced by the driving motor 25. The embossing pressure of the holding cylinder 14 must be higher than the pressure produced by the driving motor 25 in order to ensure that the embossing head 18 is kept down towards the object 7 and consequently that the penetration depth obtains a predetermined value. It is important that a predetermined penetration depth is achieved, because a penetration depth being too small causes a difficult reading of the marking, whereas a penetration depth being too high may result in an undesired notch effect reducing the strength of the object. Furthermore it results in a steadier wear of the embossing wheels 1, 2, 3, and 4, that is an advantageous fact when the servicing time of the machine is to be determined.

Figure 6:
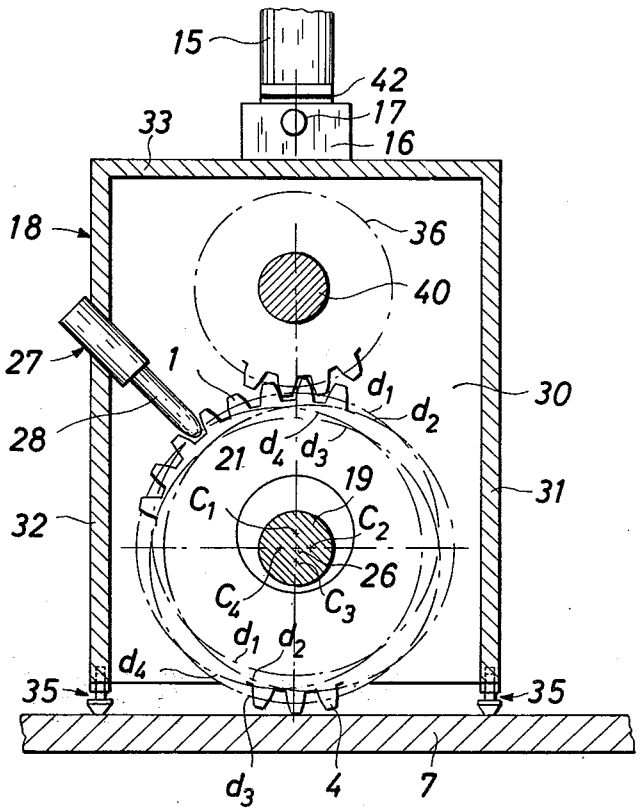
FIG. 6 is a diagrammatic sectional view taken along the line VI—VI of FIG. 5.
Figure 5:
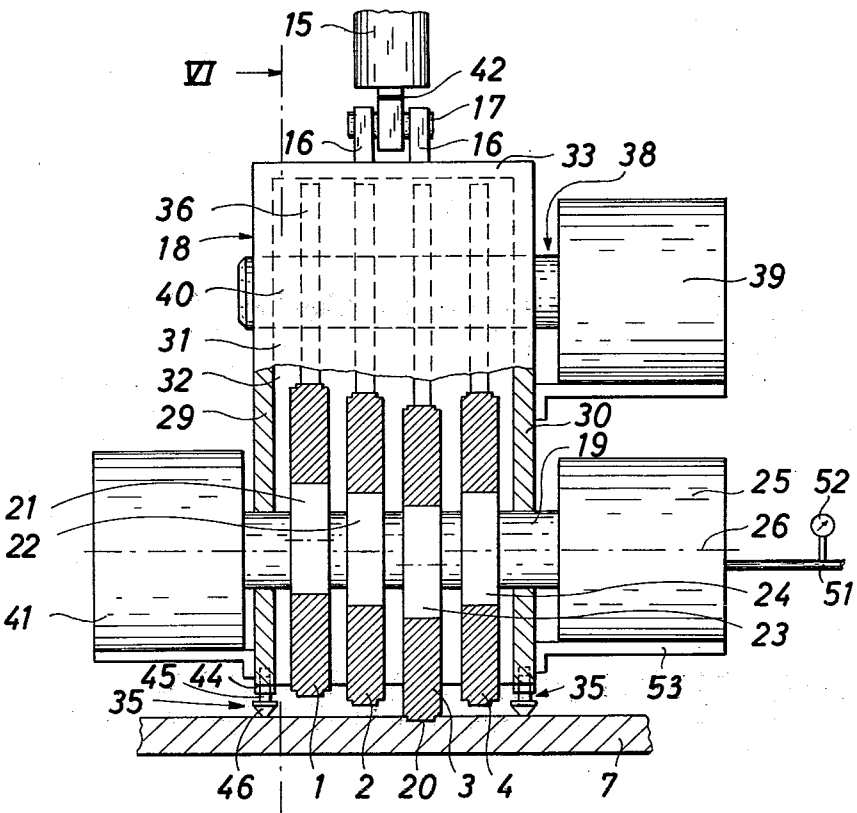
FIG. 5 is an amended embodiment of the embossing head of FIG. 3.

FIGS. 5 and 6 show an amended embodiment of the embossing head 18 of FIGS. 3 and 4. In this embodiment the rigid supporting legs 35 are adjustable, permitting an adjustment of the penetration depth of the embossing characters 20 into the surface of the object 7. Thus it is possible to adjust the embossing characters 20 of the embossing wheels 1, 2, 3, and 4 in case of wear.

Each adjustable supporting leg 35 consists of a nut 44, secured to the bottom of the embossing head 18, and a screw 45 screwed into said nut 44. This screw 45 is provided with a thrust pad 46 at its lower end. This results in a simple construction of a supporting leg 35, the length of which is easily and exactly adjusted.

Figure 8:
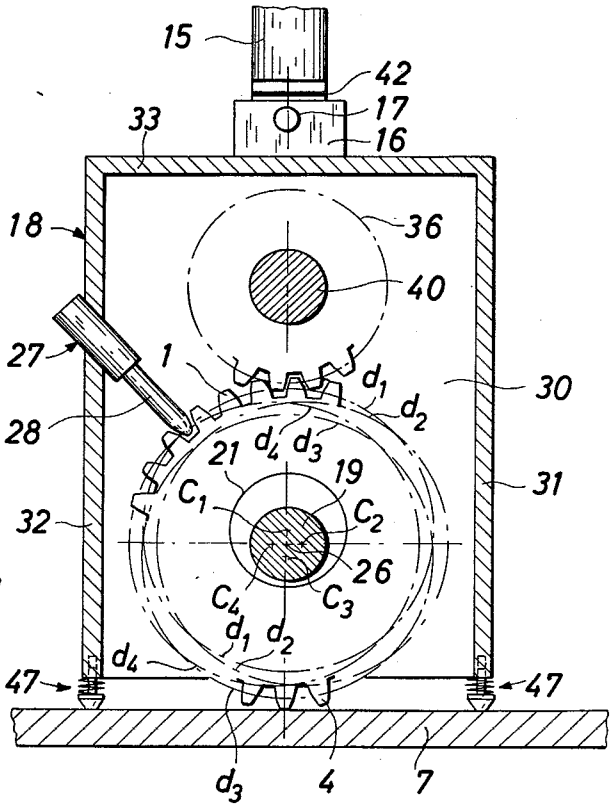
FIG. 8 is a diagrammatic sectional view taken along the line VIII—VIII of FIG. 7.
Figure 7:
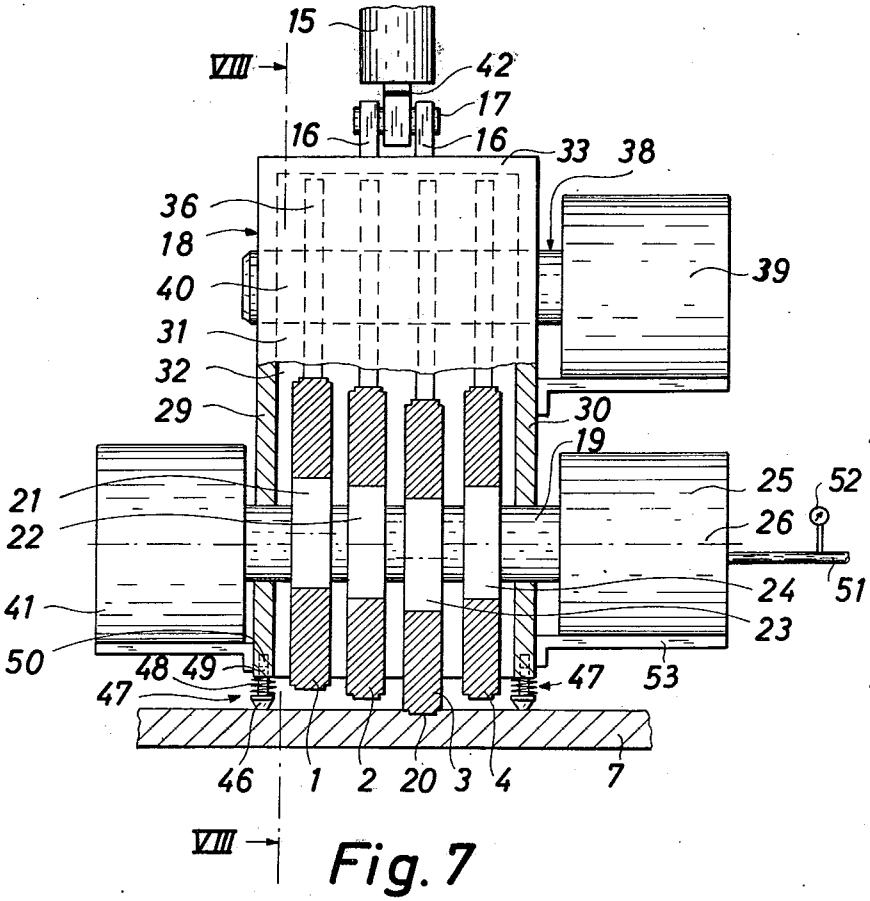
FIG. 7 is another embodiment of the embossing head of FIG. 3.

FIGS. 7 and 8 show another embodiment of the embossing head 18 of FIGS. 3 and 4, the embossing head 18 comprising resilient supporting legs 47 on its bottom side. This embodiment is advantageous because the embossing character 20 of each embossing wheel 1, 2, 3, and 4 is pressed down towards the surface of the object 7 by a predetermined pressure, being equal to the pressure of the holding cylinder 14, even if the surface of the object 7 is not completely plane, e.g. due to a dent in the object 7, and even if there are mill scales or the like foreign bodies on the object 7 under the supporting legs 47. It must be understood that the driving motor 25 may exert a pressure, that is higher than the pressure of the holding cylinder 14, said pressure lifting the embossing head 18 vertically upwards during the embossing process corresponding to the penetration depth produced by the exerted pressure.

Each supporting leg 47 consists preferably of a plurality of cup springs 48 and a guide spindle 49, stretching through said cup springs 48 and being provided with a thrust pad 46 at its lower end. This results in a simple construction of a resilient supporting leg. The upper end of each guide spindle 49 may be displaceable into a bore 50 in the bottom of the embossing head 18.

The resilient supporting legs 47 must be of such a length that the cup springs 48 are pressed together completely, and that none of the embossing wheels 1, 2, 3, and 4 touches the object 7 when the embossing head 18 is in the lowered starting position. Furthermore this length must provide the lifting of the embossing head 18 each time an embossing character is embossed in the object 7. The cup springs 48 ensure that the supporting legs 47 touch the object 7 during the embossing process, and that the embossing head 18 does not tilt, but is kept in a correct vertical position.

It is not necessary to use resilient supporting legs in order to obtain a predetermined embossing pressure. Rigid supporting legs may be used too, if only the above lengths are used. The advantage of using a predetermined firm pressure is that foreign bodies or unevennesses on the surface of the object 7 will have no damaging influence on the embossing result.

It should be noted that the two embodiments of the embossing head 18 differ, especially regarding the means exerting the embossing pressure, the first embodiment exerting the pressure by means of a predetermined penetration depth, cf. FIGS. 3 and 4 or FIGS. 5 and 6, and the second embodiment exerting the pressure by means of a predetermined embossing pressure, cf. FIGS. 7 and 8.

According to the first embodiment of the embossing head 18, providing a predetermined penetration depth, the holding cylinder 14 must exert a pressure being higher than the pressure pressing the embossing head 18 down towards the object, preventing the embossing head 18 from lifting during the embossing process. Thus a fixed penetration depth of the embossing characters into the object 7 is ensured. The real embossing pressure is exerted by the driving motor 25. The pressure of the driving motor 25 is adjusted to a suitable value in advance, since the embossing pressure for a "full stop" and for a "K" is not equal.

According to the second embodiment, providing a predetermined embossing pressure lifting the embossing head 18 from the object 7 during the embossing process, the pressure of the holding cylinder 14 decides the size of the embossing pressure to be exerted. The driving motor 25 is adapted so as to exert a higher pressure than the pressure of the holding cylinder 14 in order to lift the embossing head 18 during the embossing process corresponding to the penetration depth of the exerted pressure.

As shown in e.g. FIG. 3 the embossing wheel shaft is at its end opposite to the driving motor 25 connected to an encoder 41, secured to the outside of the embossing head 18. This encoder 41 provides partly an indication of the position of the embossing wheel shaft 19, i.e. the size of the present angular displacement of the embossing wheel shaft 19, and partly a demonstration of the fact that the embossing wheel shaft 19 is in fact turning.

The embossing wheel 18 is shown in FIGS. 3 and 5, using a fixed penetration depth, may be provided with a hydraulic driving motor 25 with an inlet pipe 51 for pressure fluid. This inlet pipe 51 may be connected to an encoder 52. Since such a pressure measuring means 52 measures the pressure, substantially being proportional to the embossing pressure, in the inlet pipe 51, it is possible to supervise that the real embossing pressure of each embossing character corresponds to the predetermined embossing pressure, e.g. by means of electronic equipment, when comparing the measuring values of the angular displacement and the embossing pressure, read on the angular encoder 41 and the pressure measuring means 52 respectively.

As shown e.g. in FIG. 7 the holding cylinder 14 may be provided with a pressure registering means 42. Thus it is possible to control the pressure by which the holding cylinder 14 acts on the embossing head 18. Furthermore the pressure registering means 42 may be adapted as an adjustable overload safety device releasing the embossing pressure when a predetermined limit value of the pressure is measured by the pressure registering means 42.

The embossing head 18 as described above comprises four supporting legs, however, one, two, three or a suitable number of supporting legs may be used.

I claim:

1. An object marking machine comprising a frame, a raisable and lowerable holding cylinder suspended from said frame, an embossing head mounted beneath and connected to said holding cylinder for movement therewith, an embossing wheel shaft rotatably mounted on said embossing head, a plurality of embossing wheels mounted in side-by-side relation on said shaft, each of said embossing wheels having outwardly projecting embossing characters along the outer periphery thereof and being rotatably mounted on said shaft to permit a selected embossing character thereof to be placed in an embossing position, a drive motor mounted on said embossing head for movement therewith and operable for rotation of said shaft, each of said embossing wheels being eccentrically mounted on said shaft with the eccentricity of each in a different direction relative to the axis of said shaft than the eccentricities of any of the others in a manner so that, on rotation of said shaft, the selected embossing character in embossing position of one of said embossing wheels is positioned at a locus of maximum eccentricity from the axis of said shaft and closer to the object to be marked than the selected embossing character in embossing position of any of the other of said embossing wheels, whereby the selected embossing characters in embossing position of said embossing wheels may be individually and sequentially pressed into engagement with the object to be marked, one at a time, on rotation of said shaft by said drive motor.

2. A machine as defined in claim 1 wherein said shaft has a plurality of eccentrics thereon with each eccentric supporting one of said embossing wheels.

3. The machine as defined in claim 2 wherein said eccentrics are in the form of eccentric sheaves mounted on said shaft for rotation therewith, said sheaves each supporting one of said embossing wheels for rotation thereon thereby permitting each embossing wheel to be turned independently of said shaft and the eccentric sheaves mounted thereon, the centers of said eccentric sheaves each being displaced from the axis of said shaft and located in planes containing the centerline of said shaft, and a blocking mechanism mounted on said embossing head, said blocking mechanism including blocking members adapted to engage the periphery of said embossing wheels to prevent rotation thereof.

4. A machine as defined in claim 3 wherein said eccentric sheaves are of equal size and eccentricity.

5. A machine as defined in claim 4 wherein said planes containing said eccentric sheave centers are disposed around the centerline of said shaft at equal angels relative to one another.

6. A machine as defined in claim 3 wherein each said embossing wheel is in the form of a gear having gear teeth formed around its outer periphery, said blocking members of said blocking mechanism being adapted to engage said gear teeth and thereby prevent rotation of said embossing wheels during rotation of said shaft, said machine further comprising an adjusting mechanism including an adjusting gear wheel in mesh with said gear teeth on each said embossing wheel, said adjusting mechanism being mounted in said embossing head above said embossing wheels and operable to selectively rotate said embossing wheels to bring a predetermined embossing character into the embossing position.

7. A machine as defined in claim 1 further comprising a plurality of supporting legs on the bottom portion of said supporting head, each said supporting leg projecting downwardly from said supporting head and terminating at equal distances below the center-line of said shaft.

8. A machine as defined in claim 7 further comprising means for adjusting the length of said supporting legs.

9. A machine as defined in claim 8 wherein said means for adjusting the length of said supporting legs comprises a nut mounted on the bottom of said supporting head, and a screw means threadably engaging said nut, said screw means having on its lower end a thrust pad for engaging the object to be embossed.

10. A machine as defined in claim 1, further comprising a plurality of resilient supporting legs mounted on and projecting downwardly from said embossing head.

11. A machine as claimed in claim 10 wherein each said resilient supporting leg comprises a plurality of cup springs and a guide spindle extending through said cup springs.

12. A machine as defined in claim 1 further comprising an encoder mounted on said embossing head, said encoder being operably connected to said shaft at the end thereof opposite said drive motor.

13. A machine as defined in claim 12 wherein said drive motor is a hydraulic motor having a fluid inlet, and further comprising pressure measuring means operatively connected to said fluid inlet.

* * * * *